United States Patent [19]

DeCloux

[11] Patent Number: 4,519,603

[45] Date of Patent: May 28, 1985

[54] EXERCISE DEVICE

[76] Inventor: Richard J. DeCloux, 1485 Belmont St., Manchester, N.H. 03104

[21] Appl. No.: 446,479

[22] Filed: Dec. 2, 1982

[51] Int. Cl.[3] ..... A63B 23/04

[52] U.S. Cl. ..... 272/73; 272/DIG. 4

[58] Field of Search ..... 272/73, DIG. 4; 73/379; 307/116; 188/24.11, 24.12, 24.13, 24.14, 24.15, 24.16, 83, 85

[56] References Cited

U.S. PATENT DOCUMENTS

| | | | |
|---|---|---|---|
| 1,778,570 | 10/1930 | Soresi | 188/85 |
| 3,360,263 | 12/1967 | Tsuru | 272/73 |
| 3,419,732 | 12/1968 | Lane | 307/116 |
| 3,501,142 | 3/1970 | Johansson | 272/73 |
| 3,767,195 | 10/1973 | Dimick | 272/73 |
| 3,845,756 | 11/1974 | Olsson | 272/73 X |

FOREIGN PATENT DOCUMENTS

| | | | |
|---|---|---|---|
| 228183 | 11/1910 | Fed. Rep. of Germany | 188/85 |
| 2301808 | 7/1974 | Fed. Rep. of Germany | 272/73 |
| 342351 | 7/1904 | France | 272/73 |
| 1058458 | 2/1967 | United Kingdom | 272/73 |
| 745529 | of 0000 | U.S.S.R. | 272/73 |

*Primary Examiner*—Arnold W. Kramer

*Attorney, Agent, or Firm*—Weingarten, Schurgin Gagnebin & Hayes

[57] ABSTRACT

Apparatus that offers its users high intensity exercise through a leg operated, rotary motion mode of exercise in which the rotary motion is selectively interrupted so as to allow a beneficial, stand-up, body lifting, method of exercise. The body-lift rotary-motion apparatus includes pedals and cranks in a fixed 180° relationship, a braking mechanism, and controls for operating the braking mechanism to provide that once the "down" pedal has moved past bottom dead center on its way up, it is momentarily braked to provide a step-up platform to permit the user to raise his body as he steps up onto the "up" pedal. In one embodiment, there is a frame to support the user while pedalling in a stand-up position and to hold the pedalling, braking, and control components, with braking accomplished by solenoid applied friction modulated by timers and voltage level controls available to the user to adjust exercise intensity and comfort, these controls being keyed to rotary pedal position by a cam-actuated switch.

11 Claims, 7 Drawing Figures

FIG. 5
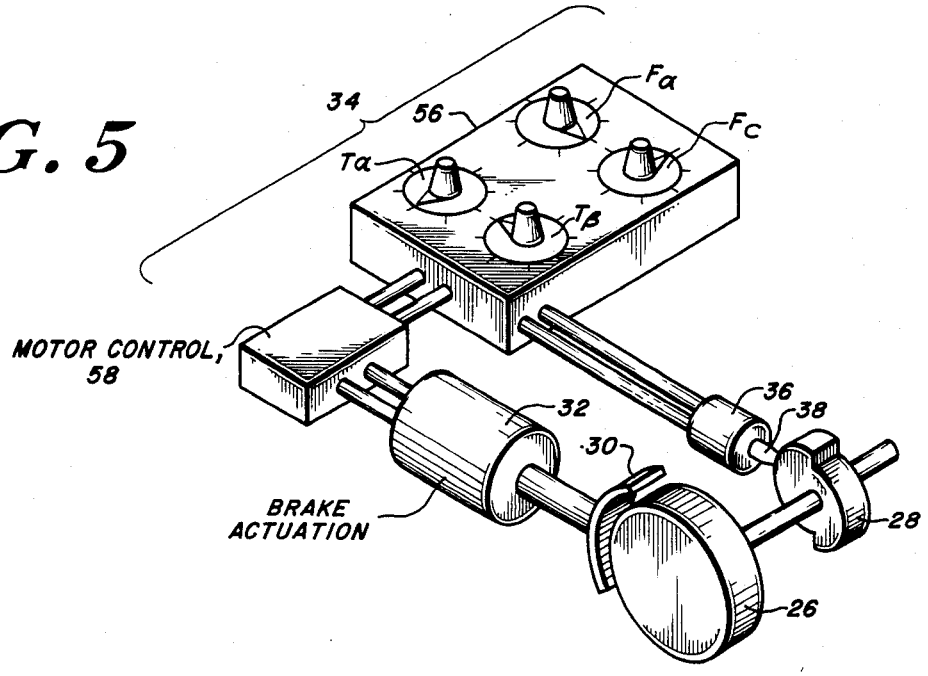
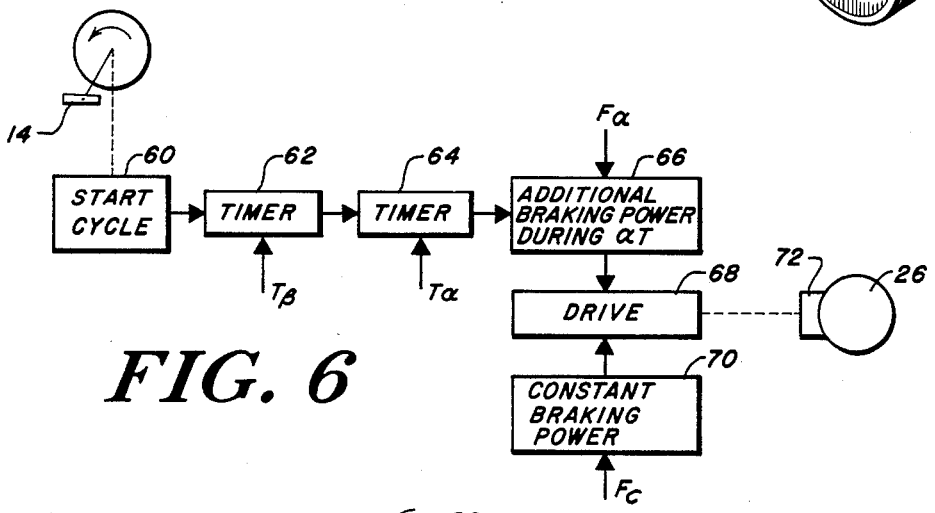
FIG. 6
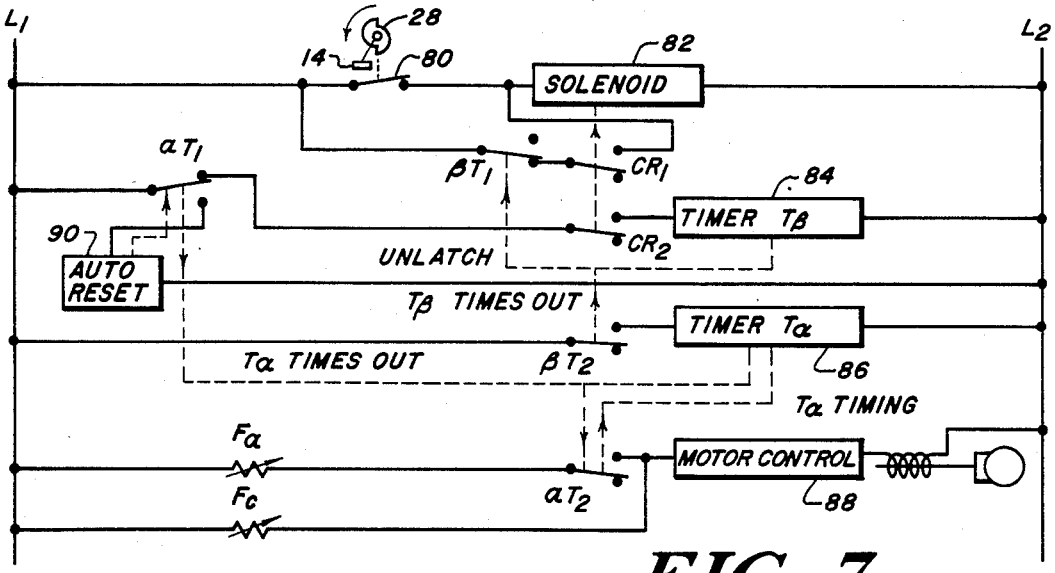
FIG. 7

EXERCISE DEVICE

FIELD OF INVENTION

This invention relates to exercise devices and more particularly to stand-up, leg operated, rotary motion, high intensity exercise devices.

BACKGROUND OF THE INVENTION

Exercise, at least at some level, can reduce chances of sustaining a heart attack by up to 60%, and dying as a result of a heart attack by up to 70%. These statistics are found in the Paffenberg report, American Journal of Epidemiology, vol. 108, pps. 161–175, 1978. The above benefits accrue in approximately linear fashion up to a maximum weekly calorie burn of 2500. Using data for stationary cycling from a book entitled AEROBICS WAY by Dr. Kenneth H. Cooper, Bantam Books, New York, 1981, a rough calculation shows that a competitive cyclist, one who can spin his legs at 105 rpm for an hour, would burn 2500 calories with five one-hour sessions of stationary cycling at that speed. The average person using a stationary exercise bicycle would have to exercise considerably longer than five hours per week or he would have to be satisfied with significantly reduced benefit.

When the objective of exercise is minimizing occurrences and fatalities associated with heart attack, exercise takes on added proportions. The most common exercise device, the exercise bicycle, requires an extensive amount of time from the user in order to deliver significant benefit. Thus, a strong need exits for an exercise device which gives more exercise benefit per unit of time.

In quantifying exercise intensity levels for stationary cycling, in the abovementioned book Dr. Cooper states that stationary cycling is awarded approximately half the points as regular cycling. This difference in exercise intensity offered by rolling bicycles compared to stationary bikes is a result of the advantage that the rolling bicycle derives from its rolling momentum which assists the user in moving his feet through top/bottom dead center. Helping the stationary bike to equal the rolling bike in exercise intensity by giving the stationary bike an action through pedal top/bottom dead center similar to that of the rolling bicycle is a significant benefit since higher exercise intensities can be obtained.

Moreover, the results of the research of physiologists Astrand and Saltin indicate why body lifting, e.g. stand-up hill pedalling, offers significantly more exercise benefit than sit-down pedalling. Astrand and Saltin discovered that the length of time an exerciser can continue at high intensity is proportional to the mass of muscle used. Stand-up, body lift pedalling uses a larger muscle mass than sit-down leg spinning. Therefore, stand-up, body lift pedalling gives opportunity for longer high intensity exercise than sit-down pedalling. Thus, any device that facilitates stand-up, body lift pedalling and offers the user help over the top/bottom dead center positions, increases the time the user can exercise at high intensity and consequently increases the intensity an exerciser can maintain for any given period of time. Thus, if in addition to making a stationary bicycle behave like a rolling bike in relation to force required to move the pedals through top/bottom dead center, a simulation of the "stand-up", hill climbing mode of bicycling were added to the conventional exercise bicycle, a longer duration of exercise at high intensity would be possible.

Present technology exists that teaches the attainment of a stand-up, body lift mode of exercise through various simulators such as illustrated in U.S. Pat. Nos. 1,409,992; 1,820,372; 1,854,473; 3,227,447; 3,381,958; 3,395,698; 3,497,215; 3,511,500; 3,529,474; 3,704,886; 3,758,112; and 3,865,366. Further, the device described in U.S. Pat. No. 3,360,263 involves an eccentric brake drum which helps reduce top/bottom dead center problems associated with normal, sit-down exercise bicycles. Other U.S. patents dealing with exercise bicycles and control systems include U.S. Pat. Nos. 359,800; 3,419,732; 3,501,142; 3,518,985; 3,744,480; 3,767,195; 3,802,698; 3,845,756; 3,848,467; 4,112,928; and 4,244,021. However, nowhere in these references is taught how exercise bicycle design can be modified to offer the desirable body lift exercise where comfortable high intensity levels can be maintained for long periods of time through a stand-up pedalling action during which the user expends energy by cyclically raising his body. It should be noted that the technique for stand-up pedalling for hill climbing is called "honking" and is a natural body response to pedalling a one speed bike up an incline.

Exercise bicycles that offer high intensity, body lift exercise as an additional mode of use are desirable because stationary bicycles are the type of machine most often associated with exercise in the minds of potential users. It should also be noted that the present low intensity, sit-down, leg churn exercise bicycles are relatively ineffective because of the low intensity at normal pedalling rates or because of the short duration exercise afforded when the user stops due to leg fatigue at high pedalling rates.

On first impression, it would seem that all one would have to do in order to use the conventional stationary exercise bicycle in a stand-up, body lift mode of exercise, would be to tighten up the brake, and pedal in a stand-up position. This approach is not effective because the increased braking removes the momentum needed to carry the user's feet through top/bottom dead center of the rotation. It is possible to pedal standing up with braking reduced so that fly wheel momentum is provided to move the user's feet through top/-bottom dead center. However, the result is that the unbraked pedals move so fast no body lift occurs. This is because the user's body and center of gravity stay fixed and the legs churn with the same result as sit-down pedalling.

SUMMARY OF THE INVENTION

In the subject invention, an exercise device is provided with relatively heavy braking which is added to the normal braking during a predetermined portion of the pedalling cycle to provide a platform for the step up from the "down" weight bearing pedal to the "up" unweighted pedal.

More particularly, apparatus is provided that offers its users high intensity exercise through a leg operated, rotary motion mode of exercise in which the rotary motion is selectively interrupted so as to allow a beneficial, stand-up, body lifting, method of exercise. The apparatus includes pedals and cranks in a fixed 180° relationship, a braking mechanism, and controls for operating the braking mechanism to provide that once the "down" pedal has moved past bottom dead center on its way up, it is momentarily braked to provide a step-up platform to permit the user to raise his body as he steps up onto the "up" pedal. In one embodiment, there is a frame to support the user while pedalling in a stand-up position and to hold the pedalling, braking, and control components, with braking accomplished by solenoid applied friction modulated by timers and voltage level controls available to the user to adjust exercise intensity and comfort, and these controls keyed to rotary pedal position by a cam-actuated switch.

In one embodiment, the position of the downwardly moving pedal is sensed before it reaches bottom dead center and a settable time interval is established to set the point in relation to bottom dead center at which heavy braking is first applied. This affords adjustability in the step-up height since the farther the "down" pedal travels on its way up, the smaller will be the step-up height. A second time interval establishes for how long the added braking is applied. The point established by this time delay determines the point at which the "up" starts its descent under the weight of the user, with both time intervals setting the speed at which the device can operate since the fall time of the "up" pedal and the distance it falls sets the speed at which the device operates and thus the exercise intensity.

In one embodiment, the heavy braking all but stops the pedal so that an individual can step from a bottom pedal which is virtually anchored, thereby permitting the raising of his body and obtaining the aforementioned advantages of body lift. In a preferred embodiment, the pedal cranks are not locked, but rather heavily braked so as to provide a smooth operation for the device. As mentioned above, a timer is provided to adjust the time that heavy braking is applied to allow the braked "down" pedal to move upwardly via the weight of the user as he steps down on the "up" pedal.

It will be appreciated that in the above device, braking levels during one rotation vary significantly to provide high intensity exercise. This is because average braking levels are much higher than the constant braking level which would have to be kept low in sit-down pedalling so that the user could get through top and bottom dead center.

In one embodiment, a fly wheel is utilized to provide a momentum assist for driving the pedals through top and bottom dead center. This momentum assist is not as large as required by an ordinary exercise bicycle. It need only overcome friction and the braking used to set the step-up rate.

It will be appreciated that without the momentum assist gain through the use of a fly wheel, the pendulous motion of the pedals under the weight of the user moves the pedals through top and bottom dead center due to the relatively light braking applied during the fall of the "up" pedal. Thus, whether or not a fly wheel is used, the pendulous motion assists the pedals through top and bottom dead center.

In summary, the application of selected braking power permits the ordinary exercise bicycle to be utilized in a stand-up mode, thereby to afford the benefits of body lifting as opposed to leg churning to the user of the device.

BRIEF DESCRIPTION OF THE DRAWINGS

These and other features of the subject invention will be better understood in connection with the detailed description taken in conjunction with the drawings of which:

FIG. 5 is a diagrammatic illustration of apparatus utilized for the braking of pedal cranks illustrating a control unit and a motor control utilized to actuate a brake solenoid;

FIG. 6 is a block diagram of a control system utilized for the application of heavy braking for the apparatus of FIGS. 1–3 and 5; and FIG. 7 is a schematic diagram of one embodiment of the control system illustrated in FIG. 6.

DETAILED DESCRIPTION

Figure 1:
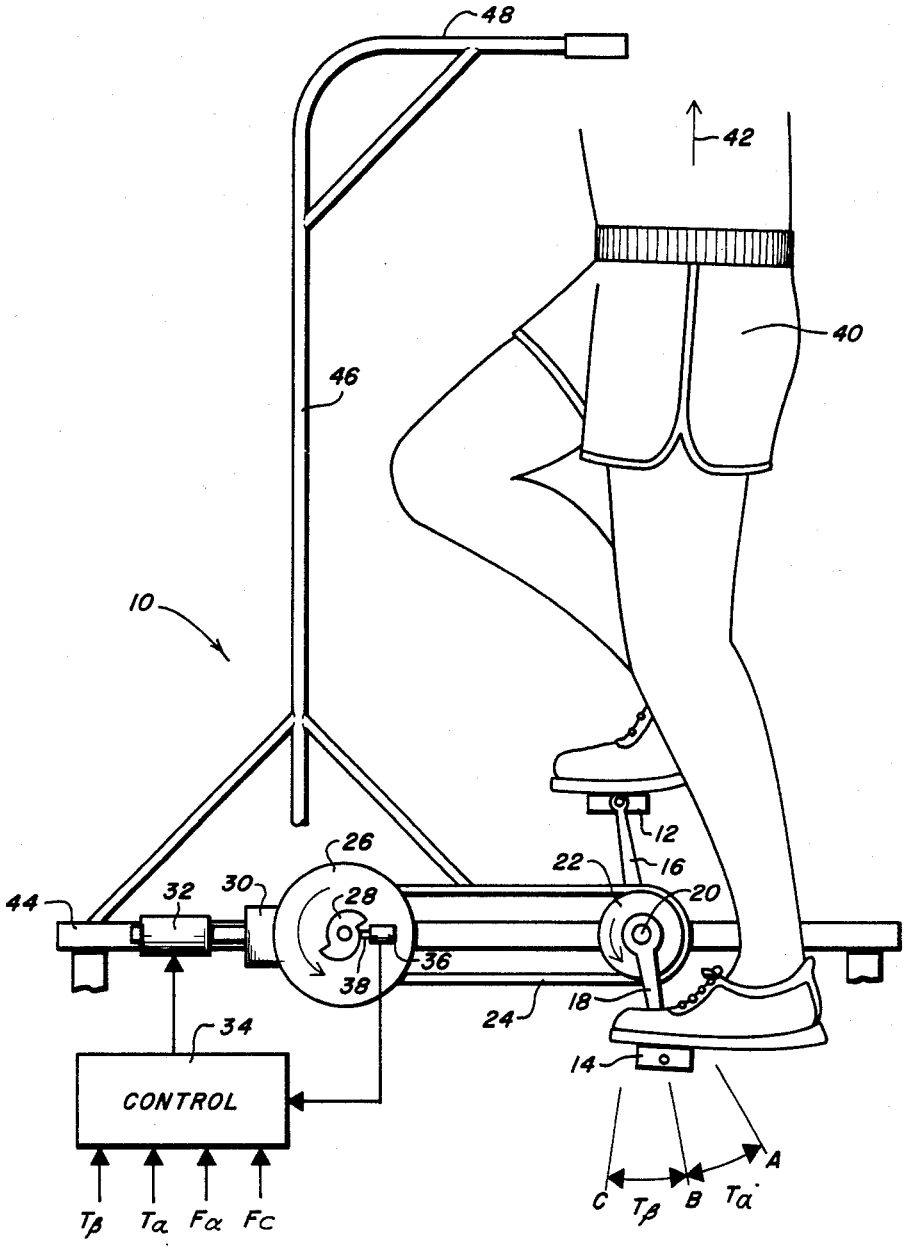
FIG. 1 is a diagrammatic illustration of a fixed crank device in which increased braking pressure is applied for a predetermined time starting just before or just after the "down" pedal reaches bottom dead center.

Referring now to FIG. 1, an exercise device 10 includes pedals 12 and 14 attached respectively to pedal cranks 16 and 18 which are locked in a 180° relationship to an axle pedal bar 20. A sprocket drive 22 is fixedly attached to bar 20 and drives a chain 24 which in turn drives a wheel or drum 26 to which is attached a cam 28.

Wheel 26 is braked by a solenoid actuated brake shoe 30 driven by a solenoid 32 under the control of a control unit 34. A cam-actuated switch 36 is mounted adjacent to cam 28 such that its cam follower 38 is actuated by the surfaces of the cam. The output of the switch is coupled to control unit 34. Control unit 34 applies electrical current to solenoid 32 to control the force that brake shoe 30 exerts against wheel 26. A force $F_c$ is applied to wheel 26 by brake shoe 30 during all portions of the cycle of the pedals. A force $F_\alpha$ is additionally applied during a predetermined period, with the predetermined period being set by $T_{\alpha,\ where\ T\alpha}$ sets the time duration that this force is applied. The initiation of the application of the force $F_\alpha$ is in timed relationship to the position of cam 28 and occurs a time $T_\beta$ after a predetermined point. This point is set from a point C which is a predetermined angular distance before bottom dead center of the associated pedal. The adjustment in $T_\beta$ sets the point B which may be at bottom dead center, or a time before or after bottom dead center. The heavy braking force $F_\alpha$ is applied for a predetermined time interval such that the point A depends upon the braking force, the speed of operation of the apparatus, and the weight of the individual. It will also be appreciated that rather than setting the step-up point B in terms of a predetermined angular displacement of a pedal crank, it is rather set by a time interval, with a $T_\beta$ and $T_\alpha$ being set for the comfort of the individual involved. Point B may also be set according to the weight of the individual and to the speed at which he operates the device. It will be appreciated that the speed of the device is dependent upon the fall time of the top pedal which is directly related to the constant braking force and the weight of the individual. Heavier constant braking force results in a reduced number of body lifts per minute since the fall time is increased. As braking is decreased, the number of body lifts per minute increases, thus increasing work. This additional work is absorbed by increased step-up braking.

As illustrated in FIG. 1, an individual 40 is shown about ready to step up on the unweighted "up" pedal 12 when weight bearing pedal 14 has reached the point B at which time heavy braking is applied. The body lift is in the direction illustrated by arrow 42, with a frame 44 being provided with an upstanding member 46 and an arm 48 to steady the individual utilizing the device.

Figure 2:
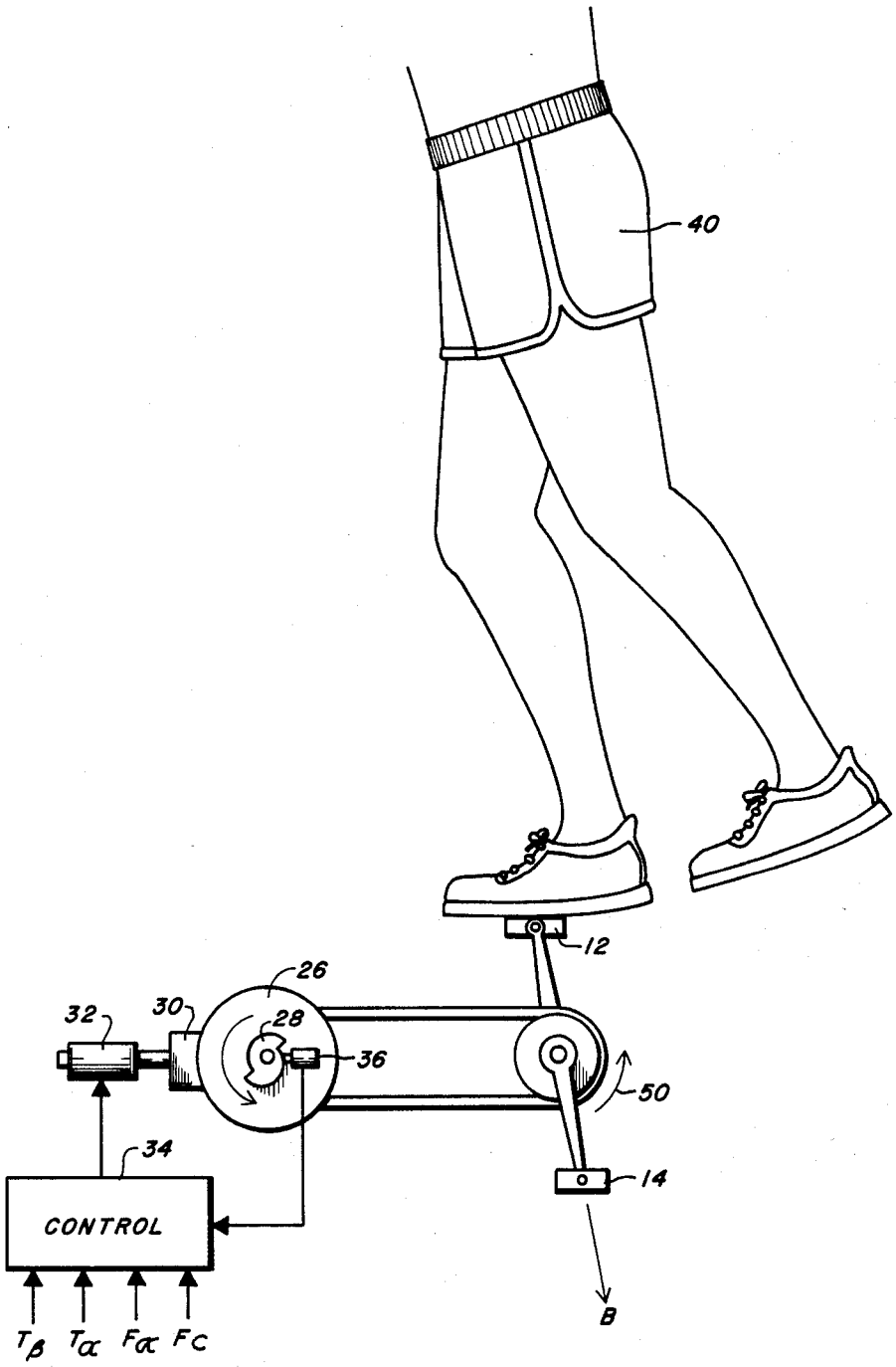
FIG. 2 is a diagrammatic illustration of the body lift associated with the device of FIG. 1 as the individual raises himself from the braked "down" pedal to the "up" pedal.
Figure 3:
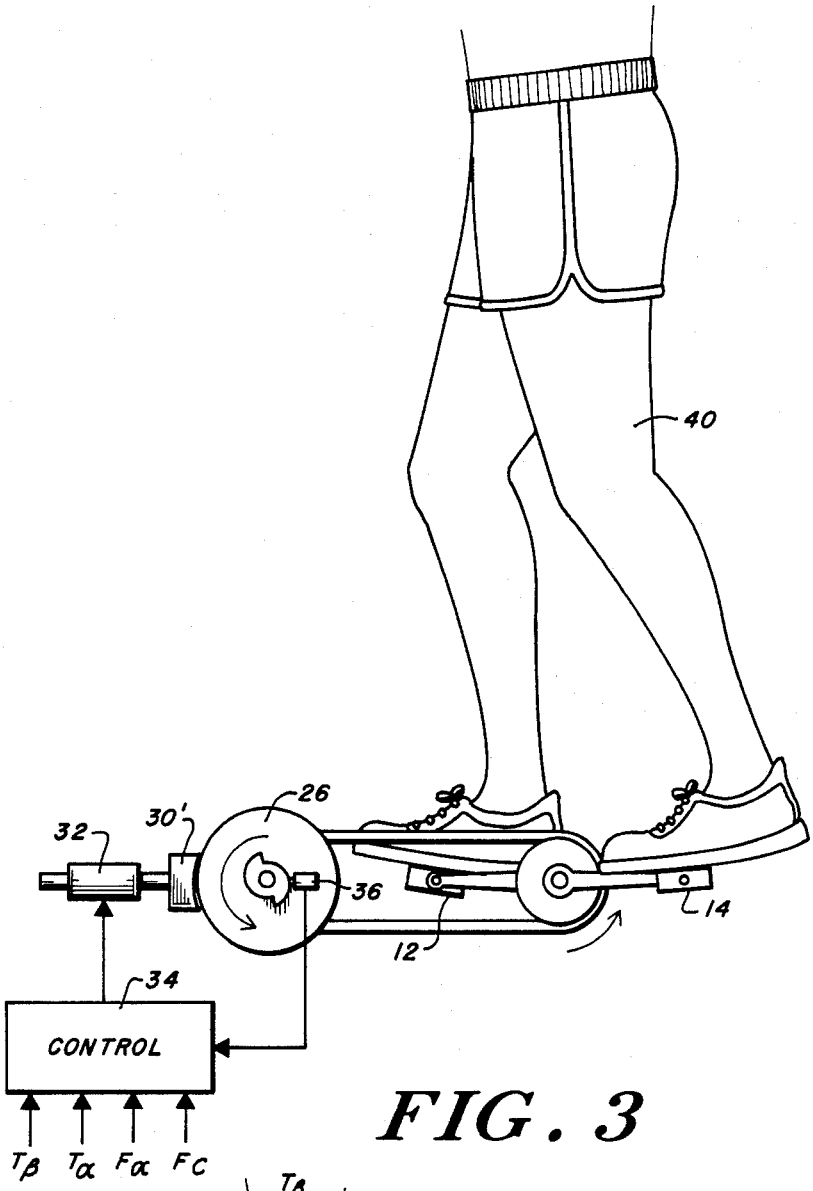
FIG. 3 is a diagrammatic illustration of the use of the apparatus of FIG. 1 in which heavy braking has been released so as to permit the controlled fall of the "up" pedal of the device of FIG. 1.
Figure 4:
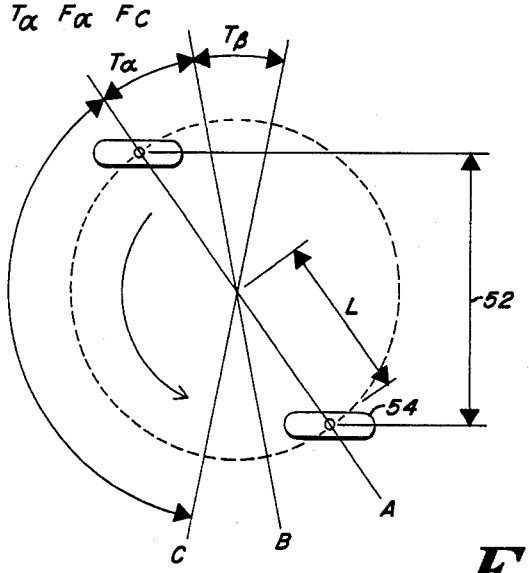
FIG. 4 is a diagram of the pedal crank angles at various points in the pedalling cycle illustrating the step-up height and the determination of the points when heavy braking is applied and released.

Referring to FIG. 2, individual 40 is illustrated as standing on "up" pedal 12 which, due to the heavy but not locking braking force, drives pedal 14 in the direction of arrow 50. Note "up" pedal 12 is now the weight bearing pedal. Referring to FIG. 3, the weight of individual 40 exerts a downward force on pedal 12 during the fall thereof, which is permitted by the decreased braking indicated by brake shoe position 30' to be moved slightly away from wheel 26. In so doing, the body of individual 40 is lowered corresponding to the position of pedal 12. Referring to FIG. 4, the step-up height is illustrated by arrow 52 to be the position reached by a pedal 54 at point A. As can be seen from this drawing, the cam of the aforementioned embodiment sets the point C from which the points A and B are measured in terms of time as opposed to angles. The setting of the times as opposed to the angles takes into account not only the user's weight, but also the speed at which he is using the device, it being understood that these can be set either in a predetermined fashion or for the comfort of the user.

Thus in order to provide for a high intensity, leg-operated, rotary motion exercise device, the user expends energy by stand-up pedalling entailing a cyclic lifting of his body weight. Pedal action is controlled in accordance with the segmented pedalling program described in connection with FIGS. 1 through 4. This program provides for the stopping of the rotation of the pedal cranks in segment $T_\alpha$ so that the user can step up from the "down" pedal to the "up" pedal. $T_\alpha$ is dimensioned and positioned in accordance with $T_\beta$ in relation to the pedal rotation top dead center in consideration of the energy being expended by the user so that stopping and step-up is complete at point A. At point A, the rotation is allowed to continue and the "up" pedal falls through bottom dead center, with step-up braking being again provided starting at point B. The energy considerations for each segment of the rotation are summarized in equation 1 which shows that the user's energy expenditure rate or exercise intensity is a function of his weight, the step-up height, and the number of times per minute he performs the step-up.

$$\text{Energy expenditure rate} = \text{Wt.} \times \text{H} \times \qquad \text{EQ1}$$

$$\text{cycle rate} = \frac{\text{Wt. } 2L\sin[90 - (\alpha + \beta)]}{T_\alpha + T_\beta + T_{fall}} \text{ K}$$

With body weight fixed, exercise intensity can be controlled during exercise by varying step-up height, e.g. by varying $T_\alpha$ and $T_\beta$ or by varying cycle rate which varies the braking during the fall of the "up" pedal to control fall time.

In one embodiment and referring now to FIG. 5, a solenoid actuated brake 30 is utilized as an energy absorber/dissipator. Control unit 34 includes a control box 56 and a motor controller 58, with rotary switches $T_\alpha$, $T_\beta$, and potentiometers $F_\alpha$ and $F_c$ determining the power applied by motor control unit 58 to solenoid 32. In one embodiment, motor control unit 58 is a pulse width modulated motor controller, with the pulse width being controlled by potentiometers $F_\alpha$ and $F_c$. The timers associated with switches $T_\alpha$ and $T_\beta$ are keyed to the shaft driven by the pedal cranks and are actuated at every 180° of pedal rotation.

In operation, while pedalling, the user sets the potentiometer which sets $F_c$ to adjust exercise intensity, with the pedalling rate being limited by the fall time. The potentiometer corresponding to $F_c$ controls fall time by biasing the width of the pulses coming out of the motor controller. The friction applied to wheel 26 by brake shoe 30 is proportional to the solenoid force, which in turn is proportional to the width of the pulses it receives from the motor controller. The higher the exercise intensity selected, the less friction is called for, and the higher the pedal velocity at the end of the fall.

When the falling pedal approaches bottom dead center, cam 28 starts the timer associated with $T_\beta$ which, according to the exercise intensity or pedal velocity and the time for $T_\beta$ selected by the user, establishes the aforementioned point B in angular pedal rotation, at which the bias resistance set by the potentiometer $F_\alpha$ is switched into the motor controller to increase braking friction, stopping the pedals to provide the opportunity for the user to step from the "down" pedal to the "up" pedal. The potentiometer $F_\alpha$ controls the step-up braking in the same fashion as potentiometer $F_c$ controls the fall braking. The timer associated with $T_\alpha$ determines how long the increased step-up braking is applied. At the end of the time set by $T_\alpha$, the force associated with $F_\alpha$ is discontinued from the motor controller and falling begins with braking as set by the potentiometer $F_c$. The user sets $T_\beta$, $F_\alpha$, and $T_\alpha$ so as to provide a smooth, cyclic pedalling action and to position step-up for maximum comfort and exercise intensity. The intensity is controlled by $F_c$ which sets how many timers per minute step-up can occur as a function of how long it takes the weight bearing pedal to fall to the point where slowing for step-up occurs.

Referring now to FIG. 6, a block diagram is provided to simplify the explanation of the subject system. In this embodiment, pedal 14 is a predetermined point ahead of bottom dead center. A start cycle unit 60 activates timer 62 which is set to time out at a time $T_\beta$ thereafter. When timer 62 times out, timer 64 is actuated for a time $T_\alpha$ to apply an additional braking power as illustrated at 66 during the time $T_\alpha$. The additional braking power is set by $F_\alpha$, with the additional braking power being supplied to drive unit 68 which is also supplied with constant braking power at 70, set by $F_c$. Drive 68 drives brake shoe 72 which applies a braking force to wheel 26.

One type switching and control system suitable for use in carrying out the functions of FIG. 6 is illustrated in FIG. 7. Here, power is provided between lines $L_1$ and $L_2$. As illustrated in FIG. 7, cam 28 momentarily actuates switch 80 which actuates solenoid 82 to pull up switches CR1 and CR2. The pulling up of switch CR1 maintains the actuation of solenoid 82 until the connection is interrupted by switch $\beta T_1$. The pull up of switch contact CR2 actuates timer 84 for the time set at $T_\beta$. When timer $T_\beta$ times out, switch $\beta T_1$ moves to the NC position, whereas the switch $\beta T_2$ connects timer 86 across the power lines thereby starting the timer. When timer 86 begins its timing, switch $\alpha T_2$ is switched to the "up" position, thereby connecting power to motor control 88 through potentiometer $F_\alpha$ in addition to the potentiometer $F_c$.

When timer 86 times out, switch $\alpha T_2$ is moved downwardly to the position shown, thereby removing $F_\alpha$ leaving motor control 88 with only the power associated with potentiometer $F_c$. Additionally when timer 86 times out, switch $\alpha T_1$ is moved downwardly so as to interrupt power to timer 84. Switch $\alpha T_1$ is automatically reset by auto reset unit 90 which obtains its power when the switch $\alpha T_1$ is moved downwardly when timer 86 times out. A predetermined time later, switch $\alpha T_1$ is returned to the position shown. The purpose of utilizing switch $\alpha T_1$ is to prevent actuation of timer 84 for a predetermined time interval during the fall of the "up" pedal. Timer 84 is commercially available from Empire Electric Division of Esterline Company as Series GP-2, Model 5S which is an interval/delay timer with plug-in automatic reset. Timer 86 is commercially available from Empire Electric Company as Series SSP, Model 10S, which is a solid-state interval/delay plug-in timer. Motor controller 88 is available commercially as Control Systems Research Corporation of Pittsburgh, Pa., Model NC414.

It will be appreciated that while the subject invention has been described in terms of a constant force to which an additional force is added, the forces can be adjustable in any suitable manner with, for instance, the normal force being removed and the heavy braking force substituted therefor.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A stationary leg-operated, pedal-driven, rotary pedal motion, stand-up, body-lifting exercising device having brake means including means for controlling said brake means for applying a first braking force, and for cyclically applying an increased braking force twice during each pedalling cycle to simulate uphill stand-up pedalling of a bicycle such that an increased resistance is produced twice during each pedalling cycle, whereby the user with one foot on the lower pedal can move himself and can stand up onto the upper pedal aided by the increased braking force as in uphill pedalling.

2. The device of claim 1 wherein said brake controlling means includes means for applying said increased braking force after the top pedal passes through top dead center and the lower pedal passes through bottom dead center.

3. The device of claim 1 wherein said device has two predetermined power stroke portions of the pedalling cycle and wherein said increased braking force is applied just prior to each power stroke portion of the pedalling cycle and is removed during said power portion, each said power stroke portion occuring after top dead center of the upper pedal and past bottom dead center of the lower pedal.

4. The device of claim 1 wherein said increased braking force is applied for a predetermined time after a top pedal passes through a predetermined point in the fall of said top pedal.

5. The device of claim 4 wherein said increased braking force is sufficient to permit step-up from said bottom pedal to the top pedal.

6. The device of claim 5 wherein said increasing braking force is insufficient to prevent rotary-motion of the pedals of said bicycle exercising device during uphill stand-up pedalling by the user.

7. The device of claim 6 wherein said increased braking force is applied for a predetermined time interval.

8. The device of claim 7 wherein said predetermined time interval is set such that said increased braking force is applied after the bottom dead center position of the bottom pedal.

9. The apparatus of claim 4 wherein said predetermined point is at a predetermined angular position before the bottom dead center of the bottom pedal.

10. The apparatus of claim 1 wherein said bicycle exercising device includes a pedal crank driven wheel and a fly wheel coupled thereto.

11. Apparatus for increasing the high intensity use of an exercise device having a pedal driven braked wheel comprising:

means for applying increased braking force to a continuously braked wheel sufficient to permit step-up from a weight-bearing pedal in a down position to an unweighted pedal when said unweighted pedal is in an up position beyond top dead center and for removing said increased braking force during a predetermined power stroke, said increased braking force applying means including:

a first timer;

means for actuating said first timer when a weight-bearing pedal arrives at a predetermined angular position and the fall thereof from an associated up position;

a second timer; and, means for actuating said second timer when said first timer times out, said means for applying said increased braking force applying said force during the time interval said second timer is timing;

said apparatus further including means for adjusting the magnitude of said increased force wherein said last mentioned means includes a voltage-controlled motor controller for providing a series of output pulses having adjustable pulse widths, a solenoid having an input coupled to the output of said motor controller, and a brake shoe actuated by said solenoid, said means for adjusting the magnitude of said braking force including means for applying an increased voltage to said motor controller for increasing said pulse widths.

* * * * *